US009045971B2

(12) United States Patent
McKay

(10) Patent No.: US 9,045,971 B2
(45) Date of Patent: Jun. 2, 2015

(54) SUBSEA SYSTEM

(75) Inventor: David Ernest McKay, Aberdeen (GB)

(73) Assignee: Subsea Technologies Group Limited, Aberdeen (GB)

( * ) Notice: Subject to any disclaimer, the term of this patent is extended or adjusted under 35 U.S.C. 154(b) by 900 days.

(21) Appl. No.: 13/140,693

(22) PCT Filed: Dec. 17, 2009

(86) PCT No.: PCT/GB2009/051730

§ 371 (c)(1),
(2), (4) Date: Aug. 2, 2011

(87) PCT Pub. No.: WO2010/070348

PCT Pub. Date: Jun. 24, 2010

(65) Prior Publication Data

US 2011/0297389 A1 Dec. 8, 2011

(30) Foreign Application Priority Data

Dec. 17, 2008 (GB) ..... 0822978.3

(51) Int. Cl.

| | |
|---|---|
| ***E21B 33/038*** | (2006.01) |
| ***E21B 33/076*** | (2006.01) |
| ***E21B 43/013*** | (2006.01) |
| ***B66D 1/36*** | (2006.01) |

(52) U.S. Cl.

CPC ..... *E21B 43/0135* (2013.01); *E21B 33/038* (2013.01); *E21B 33/076* (2013.01); *B66D 1/36* (2013.01)

(58) Field of Classification Search

CPC . E21B 33/038; E21B 33/076; E21B 43/0135; E21B 41/0007

USPC ..... 166/349, 343, 351, 77.1, 85.5, 241.1, 166/241.5

See application file for complete search history.

(56) References Cited

U.S. PATENT DOCUMENTS

| | | | | | |
|---|---|---|---|---|---|
| 3,021,909 | A | * | 2/1962 | Postlewaite | 175/7 |
| 3,415,317 | A | * | 12/1968 | Drivet | 166/336 |
| 3,477,236 | A | * | 11/1969 | Burrus | 405/204 |
| 3,503,442 | A | * | 3/1970 | Dodd et al. | 166/343 |
| 3,517,737 | A | * | 6/1970 | Petersen | 166/343 |
| 3,943,725 | A | * | 3/1976 | Pennock | 405/195.1 |
| 4,075,862 | A | * | 2/1978 | Ames | 405/169 |
| 4,457,378 | A | * | 7/1984 | Watkins | 166/347 |

(Continued)

FOREIGN PATENT DOCUMENTS

| | | | |
|---|---|---|---|
| WO | WO-01/21479 | A1 | 3/2001 |
| WO | WO-2006/027553 | A1 | 3/2006 |

OTHER PUBLICATIONS

Georgescu, Mihnea, "International Search Report", prepared for PCT/GB2009/051730, as mailed Sep. 13, 2010, 6 pages.

*Primary Examiner* — Matthew Buck
(74) *Attorney, Agent, or Firm* — Winstead PC

(57) ABSTRACT

A subsea system for intervention or deployment comprising a spool (9, 109) adapted for mounting subsea, a carrier (4, 4, 5', 34, 104) adapted for suspension from a surface vessel or platform, a guide line (8, 108) wound on the spool, the free end of the guide line connected to the carrier and means (11) for driving the spool in one direction to pay out a length of guide line as the distance between the spool and the carrier is increased and in the other direction to reel in the length of guide line as the distance between the spool and the carrier decreases.

22 Claims, 20 Drawing Sheets

(56) References Cited

U.S. PATENT DOCUMENTS

| | | | | |
|---|---|---|---|---|
| 4,459,065 | A | 7/1984 | Morton | |
| 4,459,931 | A * | 7/1984 | Glidden | 114/230.1 |
| 4,525,101 | A * | 6/1985 | Stevens et al. | 405/169 |
| 4,541,754 | A * | 9/1985 | Castel et al. | 405/168.1 |
| 4,591,292 | A * | 5/1986 | Stevens et al. | 405/169 |
| 4,702,320 | A * | 10/1987 | Gano et al. | 166/343 |
| 4,842,075 | A * | 6/1989 | Kalvenes et al. | 166/341 |
| 6,167,831 | B1 | 1/2001 | Watt et al. | |
| 6,409,428 | B1 * | 6/2002 | Moog | 405/169 |
| 7,225,877 | B2 * | 6/2007 | Yater | 166/344 |
| 7,241,077 | B2 * | 7/2007 | Webster et al. | 405/195.1 |
| 8,006,765 | B2 * | 8/2011 | Richards et al. | 166/351 |
| 8,376,049 | B2 * | 2/2013 | Bell | 166/339 |
| 2002/0040782 | A1 | 4/2002 | Rytlewski et al. | |
| 2007/0177944 | A1 * | 8/2007 | Smith et al. | 405/169 |
| 2008/0265226 | A1 * | 10/2008 | Richards | 254/267 |

* cited by examiner

SUBSEA SYSTEM

This invention relates to a subsea system and more particularly to a subsea system for intervention or deployment and more particularly to a subsea system for guiding equipment through a column of water. The invention finds particular application in deploying equipment in deep water from a surface vessel or platform to a subsea installation.

One of the main industries to use subsea installations is the oil and gas industry. Equipment may be installed on the sea floor around a subsea well. This equipment may for example facilitate the introduction of equipment into the well.

A tool string may be deployed from a surface vessel or platform and fed into the well through the subsea installation to allow downhole processes such as production enhancement and maintenance operations to be carried out.

The equipment must be deployed from the surface to the sea bed where it passes through the subsea installation and into the well.

Riserless subsea well intervention involves the deployment of a well entry and pressure control system from a dynamically positioned vessel onto an existing subsea well to enable the deployment and operation of wireline tools into the well bore with the well up to full operating pressure. The wireline may be a slickline provided by a single strand of wire with a smooth outer diameter, a braided line formed of a bundle of wires twisted together or an e-line formed by a bundle of wires with integrated electrical power and/or signal wires.

The wireline tools are commonly deployed from the vessel and run down guide lines which direct and align them with the pressure control system which is already locked onto the subsea xmas tree and containing the well pressure.

The key feature of riserless Intervention is that the subsea system is connected to the vessel at surface by cables, wires and a control umbilical only, as opposed to a rigid or semi rigid structure or a pressure retaining conduit to surface. All pressure control and hydrocarbon containment occurs subsea with the wireline travelling from the deploying vessel to the subsea system through open water, then passing through a subsea pressure control device and into the wellbore.

Unlike conventional riser intervention where equipment is made up on the rig floor section by section, riserless intervention systems are generally deployed and recovered on wire as one or two units allowing much quicker deployment to deep water wells than can be achieved with equivalent riser systems.

Typically, during normal operations in shallow water (<600 m) connections between the vessel at surface and the intervention system subsea consist of four guide lines, the umbilical and the wireline. Typically, in deeper water depths (>600 m) guidelineless systems are used consisting of the wireline and the umbilical only. This is because it is not possible to apply sufficient tension to maintain the separation between the guidewires beyond 600 m.

At any water depth using any system it is very important that the lines from the vessel to the intervention system do not clash, in particular the umbilical and the wireline. The wireline is deployed and recovered at rates up to 90 ft/min which is sufficient to cut through the umbilical if the two were to come into contact.

In general, management of the deployed lines is critical in ensuring safe and reliable deployment, operations and recovery of the intervention system as a whole. Failure to prevent unintentional line contact or line entanglement can result in severe operational difficulties and or suspended operations.

Beyond guideline depth when deploying equipment free hanging, the equipment is deployed free hanging off the surface vessel or platform and usually compensated to minimise any movement of the deployed equipment and the deployment wire induced by vessel movement and any resulting misalignment at the target depth is dealt with by, for example, deploying an ROV into the water around the subsea installation.

When the equipment is deployed without guidelines as in the free hanging operation described above, the equipment is moved around in the water column by the effect of the current on the equipment and also on the line on which it is deployed. The current profile from surface to seabed changes constantly depending upon the weather conditions but different regional profiles also affect the movement of the equipment through the water.

In particular, if the current profile is high near the surface of the water column and the load being deployed is relatively light weight then the equipment can be forced off vertical to a fairly high degree just below the surface vessel or platform. This leads to the risk of the deployed equipment or any lines connected to the equipment fouling on equipment protruding from the hull of the vessel; fixed protrusions such as vessel thrusters or temporarily deployed equipment such as acoustic buoys, pod lines, umbilicals or the like.

As the deployed equipment passes through the water column it is still in danger of becoming entangled and abrading against other lines deployed from the vessel or platform. In many situations additional lines may have been deployed from the same vessel to carry out additional activities and/or support the main deployment. In some cases these lines may be fixed at the seabed as in the case of the standard guide lines discussed above, or may be free hanging as in the case of ROV umbilicals.

As the deployed equipment approaches the target depth, the location of the equipment may be some distance off from the target due to the effect of the current. It is therefore necessary to employ a means of guiding the deployed equipment back on target. This is normally done using an ROV or similar equipment. Technology exists to monitor the location of the equipment relative to the target and so at least know where it is, but the requirement to locate it, and manipulate it back onto target for final deployment still exists and has to be managed.

Typically, intervention systems use fluids to operate and manage the well and also to flush out the lubricator after it has been exposed to fluids from the well. This means that either a constant supply of fluid has to be pumped to the intervention system from the vessel or the fluid must be stored subsea on the intervention system to last a predetermined period of time.

There are basic but costly issues with both these options. Umbilical's are expensive and whilst in shallow waters it is feasible to have an umbilical containing multiple hoses for both the supply of fluids and for the control of the well, but as the water depth increases so does the weight of the umbilical and it ultimately becomes unable to support its own weight. Expensive and complex handling equipment is then required to manage the umbilical.

Storing fluid on the intervention system adds weight and bulk onto already large structures which in turn leads to handling issues. The other problem that arises is determining how much fluid is stored on the system for dealing with fluid loss due to leaks etc.

A combination of the two can be made but it creates an overly complicated and expensive solution. In deepwater in particular, system complexity increases along with the overall size and weight of the equipment required on the vessel. This can involve complex interfacing with the vessel or limitations on the availability of vessels suitable to carry out the work due to the basic footprint of the equipment spread and/or the lifting and handling requirements.

This invention describes an intervention system designed to address the main issues described above.

It is an object of the present invention to provide a subsea intervention system for guiding the deployment of equipment subsea, particularly from a surface vessel or platform that addresses the above mentioned concerns with known deployment methods.

It is also an object of the present invention to provide a subsea intervention system which combines the benefits of a guide line for deployment and recovery with the benefits of a guidelineless system in avoiding parallel wires running through the water column which can become fouled or abraded whilst guiding the equipment directly to the desired location.

Furthermore it is an object of the present invention to provide a subsea intervention system which addresses the problem of providing subsea fluid power.

According to one aspect of the present invention there is provided a subsea system for intervention or deployment comprising a spool adapted for mounting subsea, a carrier adapted for suspension from a surface vessel or platform, a guide line wound on the spool, the free end of the guide line connected to the carrier and means for driving the spool in one direction to pay out a length of guide line as the distance between the spool and the carrier is increased and in the other direction to reel in the length of guide line as the distance between the spool and the carrier decreases.

The guide line ensures that as the carrier approaches the spool, both the carrier and any equipment to which it is mounted or attached will be drawn towards the spool thus ensuring optimised alignment of the equipment.

The carrier may be anything which is deployed to and recovered from the seabed regularly during a deepwater operation. Advantageously, the carrier comprises a subsea fluid power unit. Alternatively, the carrier comprises a test/lift mandrel. Alternatively the carrier comprises a lubricator section.

Conveniently, the guide line comprises upper and lower guide lines.

Advantageously, the lower guide line maintains power, communications and/or guidance across any equipment suspended from the carrier.

Preferably, guide means are provided for guiding the guide line between the spool and the carrier.

Advantageously, the guide means comprise a guide arm. Conveniently the guide arm may be mounted on or adjacent to the spool. In some embodiments, the guide means may comprise an L-shaped guide arm.

Conveniently, the guide means further comprise one or more rollers or sheaves mounted for rotation on the guide arm. In use the guide line can be passed along the guide arm and around the rollers or sheaves from the spool to the carrier.

Alternatively the guide means may comprise a receptacle mounted on a subsea component through which receptacle the guide line passes.

Preferably the receptacle is provided with opposed rollers to guide and/or grip the guide line.

Advantageously the guide means further comprises channelling means mountable on the subsea component for orienting the carrier as the carrier approaches the spool.

Preferably the channelling means comprise a pair of opposed elongate curved members.

Advantageously the carrier has an arm extending from a mandrel which is suspended from a surface vessel or platform. Conveniently, the carrier extends from a mandrel connected to the surface via a wireline.

Alternatively the carrier may extend from a test or lift mandrel suspended from the surface on a hoist line.

In some embodiments the carrier may be integral with the mandrel.

Preferably the spool is vertically oriented.

Advantageously the driving means is a motor. Preferably the motor is a hydraulic or electric motor.

According to a further aspect of the present invention there is provided a method of guiding a component through a water column between the surface and a subsea installation comprising the steps of attaching one end of a guide line to a subsea spool, attaching the other end of the guide line to the component, and driving the spool to manoeuvre the component to the required position.

Preferably the method further comprises the step of mounting the component on or to a carrier and attaching the other end of the guide line to the carrier.

Advantageously the method further includes the step of aligning the guided component with a further subsea component.

Preferably the step of aligning comprises rotating the guided component about a vertical axis prior to docking with the subsea component.

An embodiment of the present invention will now be described with reference to and as shown in the accompanying drawings in which:—

FIG. 1 is a schematic view of a subsea system according to an aspect of the present invention;

FIG. 2 (*a*) to (*i*) illustrate the operation of the subsea system of the present invention;

Figure 1:
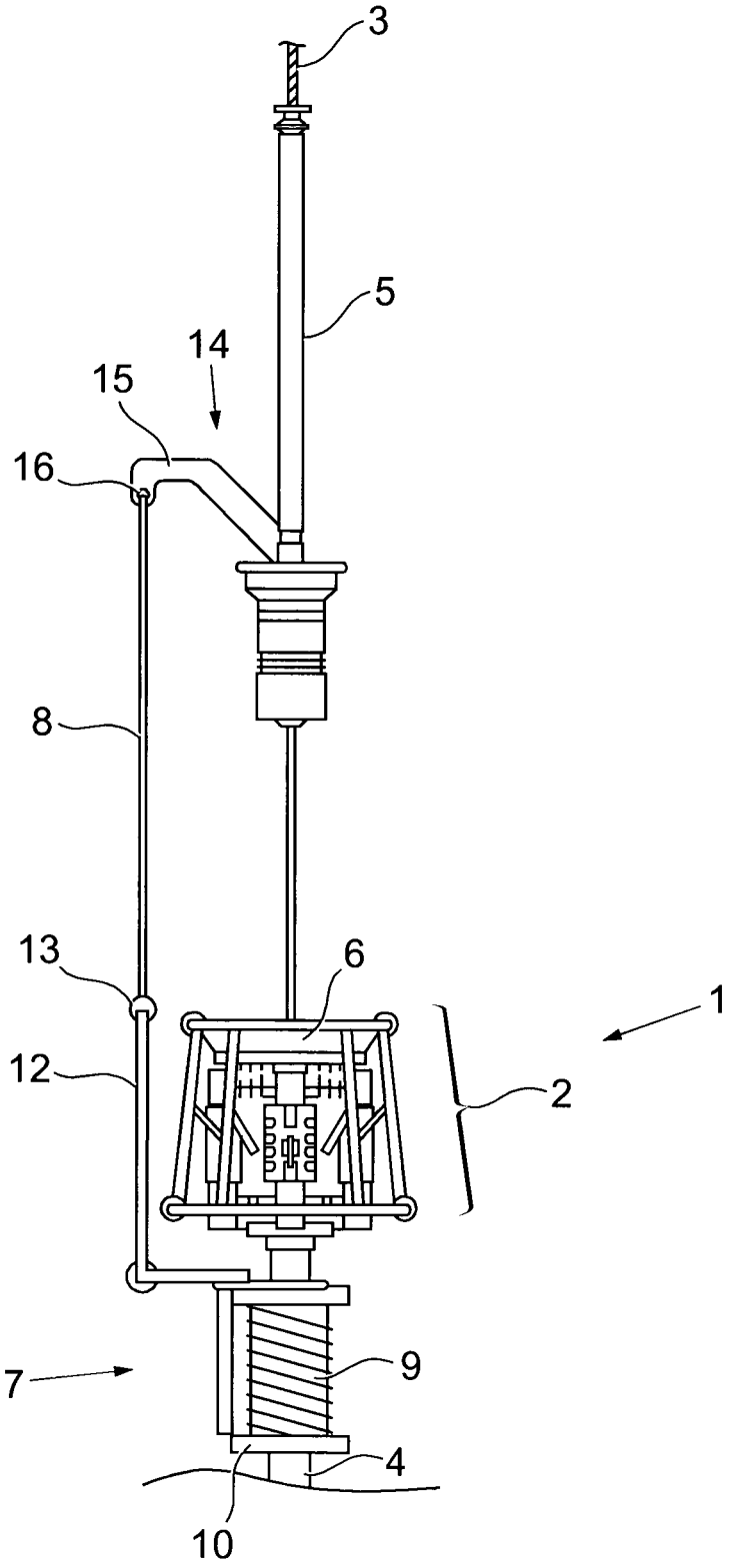

Turning now to the figures, there is shown in FIG. 1 an embodiment of the present invention in which a subsea system 1 preferably adapted for deployment or intervention is mounted on a subsea latch 2 such as for example a pressure control head PCH which is in turn connected to a subsea wellhead not shown in the figures.

A wireline 3 for carrying out well intervention operations extends from the surface through the pressure control head, through the subsea wellhead and down into the well below.

The subsea latch is shown as a connector 6 mounted upon a lubricator section 4 which is mounted on or above the subsea wellhead. A wireline mandrel 5 is suspended on the wireline from the surface and can be inserted into or removed from the connector. The wireline mandrel can be locked in position within the connector.

The subsea system comprises a storage means 7 for storing a length of guide line 8. In one embodiment the guide line is wound onto the storage means. The storage means comprises a vertically oriented drum or reel 9 which comprises a cylindrical body which in some embodiments is provided with enlarged flanges 10 at either end to prevent the guide line from falling off the cylindrical body and fouling on the drum as the drum rotates.

In the embodiment shown, the drum is mounted below the connector of the pressure control head around the central axis of the lubricator pipe section. This keeps the drum close into the pipe and helps protect it from accidental damage during handling and from impact damage caused by any dropped objects falling through the water column and striking the drum.

Figure 9:
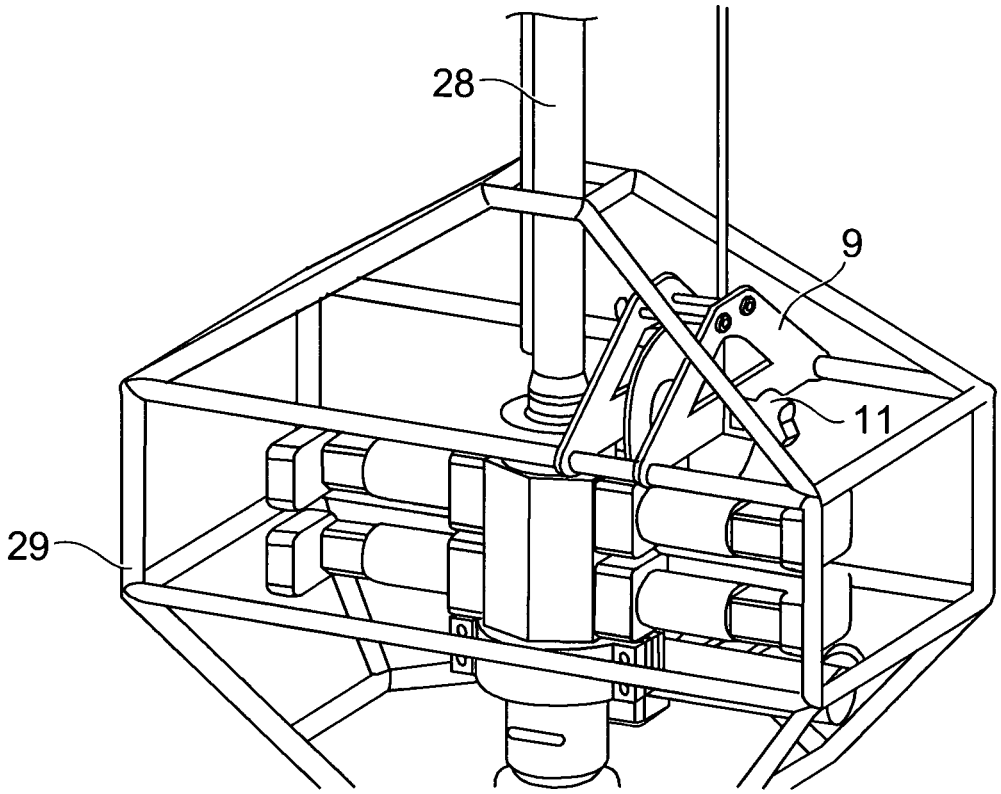
FIG. 9 is a schematic perspective view of a subsea system according to a further aspect of the present invention.

A driving means 11 as shown in FIG. 9 is mounted adjacent to the drum for rotating the drum. The driving means drives the drum in opposing directions such that in the first direction the guide line is paid out from the drum and in the second, opposite direction the guide line is reeled onto the drum.

The driving means is preferably a hydraulic or electric motor which is capable of operating in a subsea environment.

A guidance arm 12 extends horizontally from the upper flange 10 of the drum and extends outwards a sufficient distance to clear the pressure control head. The arm then angles upwards substantially through 90° to extend vertically to a position adjacent to the top of or above the pressure control head. Therefore, in the illustrated example, the guidance arm is substantially L-shaped.

Routing means 13 for the guide line are provided on the guidance arm. In the illustrated embodiment, the routing means are mounted at the angle of the L-shaped arm and also at the distal end of the arm. However, the routing means may be provided at any position along the guidance arm. The routing means may comprise one or more sheaves or rollers around which the guide line can pass as will be described further below.

One end of the guide line is fixed to the drum 9 and the guide line is wound around the drum and passed along the guidance arm 12 and around the routing means 13.

As shown in FIG. 1 a wireline mandrel 5 is suspended on the wireline supported from the surface, the mandrel being mounted above the subsea latch 2. A mandrel arm 14 extends from the mandrel. In some embodiments the mandrel may be a test or lift mandrel on a hoist line which is intended to be locked into a connector of the subsea latch The mandrel arm may be integrally formed with the mandrel or may be attached thereto by a suitable fixing means. In some embodiments, the mandrel arm may be integral with or fixed to the test/lift mandrel or may be integral with or fixed to a mounting plate which is mounted to the test/lift mandrel.

In the embodiment of FIG. 1, the mandrel arm extends upwards at an angle of about 45° to the upper surface of the mandrel and has a substantially horizontal projection 15 formed at the free end of the arm.

The free end of the guide line 8 is fixed to the mandrel arm. The end of the mandrel arm provides a fixing point 16 for the free end of the guide line. In one embodiment the fixing point may be an aperture through which the free end of the guide line can be passed and tied off.

The operation of the equipment will now be described with reference to the operating cycle illustrated in FIGS. 2 (*a*) to (*i*).

The subsea system 1 is mounted on a component which is temporarily deployed subsea. In the embodiment illustrated, this component is a well control package P which engages with the subsea Xmas Tree T. A subsea latch 2 is mounted at the top of the well control package.

Initially the subsea system is mounted on the well control package P on the vessel prior to deployment. At this stage the test or lift mandrel is locked into the subsea latch 2 and the guide line 8 of the subsea system is withdrawn by a sufficient length such that the free end passes around the routing means 13 of the guidance arm 12 and is attached to the fixing point 16 of the mandrel arm 14.

Figure 2:
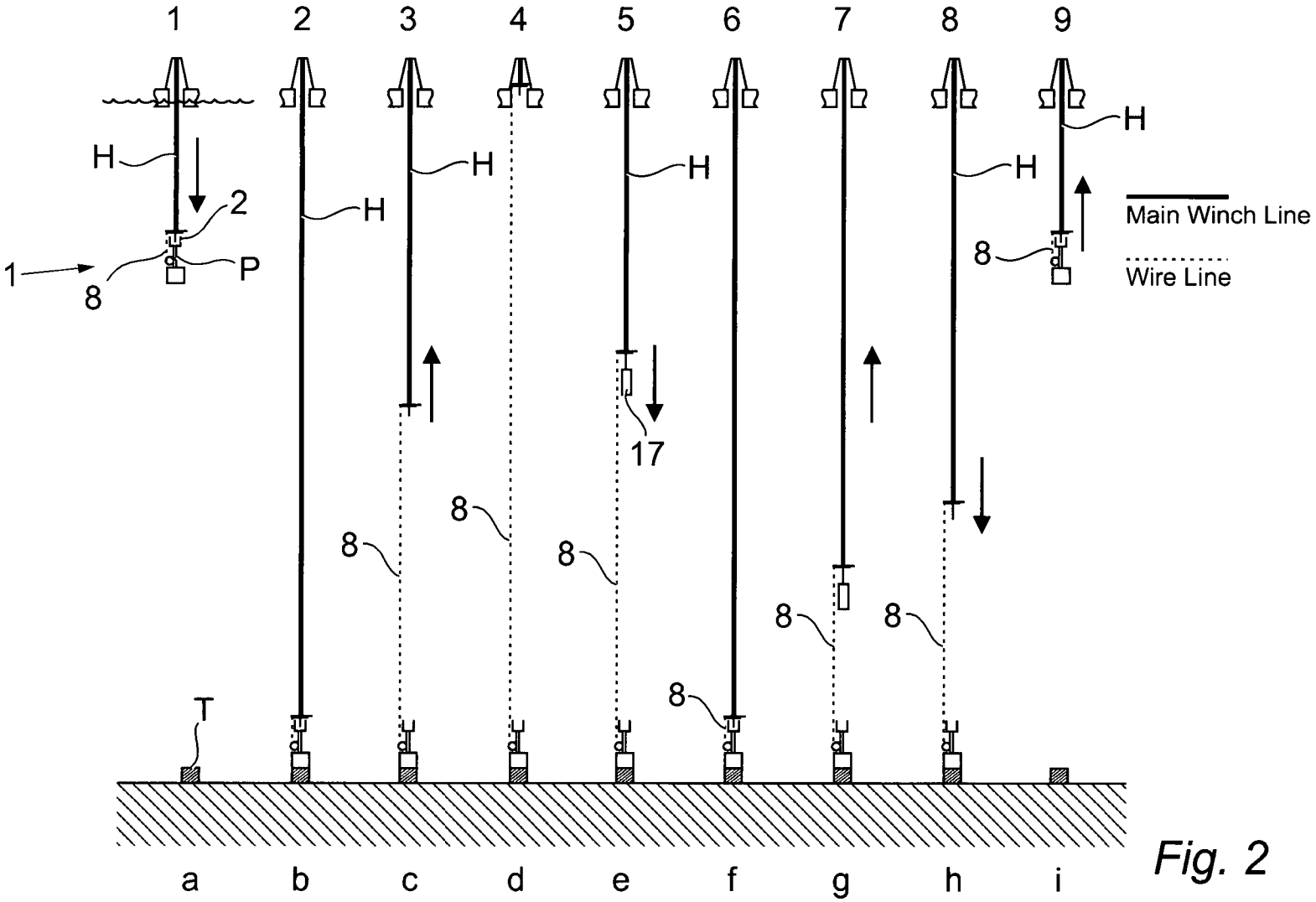

The well control package is deployed subsea on a hoist line H as shown in FIG. 2 (*a*) and engaged with the Xmas Tree and connected to the power supply of that component see FIG. 2 (*b*). From this point on the subsea system provides a constant tension on the guide line 8 which is governed by the operator on the vessel above.

Once in position subsea the test or lift mandrel 5 is unlocked remotely by the operator on the surface and raised to the surface by withdrawing the hoist line H. A winch at the surface (not shown) provides sufficient tension to overcome the weight of the mandrel and the back tension of the subsea guidance system 1 to raise the mandrel to the surface.

As the test or lift mandrel 5 is raised through the water column shown in FIG. 2 (*c*), the mandrel arm 14 is raised and the guide line 8 fixed thereto is paid out from the subsea drum 9 which remains fixed in position on the subsea installation.

When the mandrel 5 reaches the surface, the guide line 8 from the subsea guidance system is tied off to a winch or structure on the vessel that will hold it while the test or lift mandrel 5 is disconnected and replaced with a wireline mandrel (load carrier in this case) and the appropriate wireline tool string 17 (the load) see FIG. 2 (*d*). The wireline mandrel with the guidance wire 8 attached is then deployed subsea.

The wireline mandrel and wireline toolstring 17 are deployed through the water column with the tension in the combined line winches controlling the position of the load see FIG. 2 (*e*).

As the surface winch pays out, the subsea system 1 reels in the guide line 8, pulling the mandrel and wireline string 17 attached thereto to its required location. This ensures that the mandrel is lowered through the water column to the required position and prevents the mandrel from being adversely affected by localised currents or conditions as shown in FIG. 2 (*f*).

When all wireline work is completed the wireline mandrel and toolstring 17 are recovered to the surface which pays out the guide line 8 as described above from the subsea reel see FIG. 2 (*g*).

If further runs with wireline tools 17 are required then the sequence of events is repeated as required from FIG. 2 (*d*) to FIG. 2 (*g*).

On completion of the downhole work the wireline mandrel and toolstring 17 is retrieved and when it reaches the surface for the final time it is replaced with the test or lift mandrel 5 once again and this is then run subsea on the hoist line H to engage with the subsea latch 2 see FIG. 2 (*h*).

The well control package P complete with subsea latch 2 is disconnected from the subsea wellhead and the assembly retrieved to surface as shown in FIG. 2 (*i*) to complete the job.

It will be appreciated that the present invention provides an apparatus and method for controlling the deployment of equipment subsea through a water column which mitigates the adverse affects of localised weather conditions and also localised current profiles. Embodiments of the invention provide for a cost effective and simple solution to the problems previously highlighted which can occur when the equipment deployed does not pass smoothly through the water column. There is no need for divers or ROV intervention to ensure that the equipment is efficiently deployed to the required area.

The tension in the wireline 3 or hoist line H from the mandrel arm 14 to the surface and the tension in the guide line 8 from the mandrel arm to the spool 9 ensures that any component to which the mandrel arm 14 is mounted or fixed will be securely manoeuvred between the surface and desired location subsea.

Figure 3:
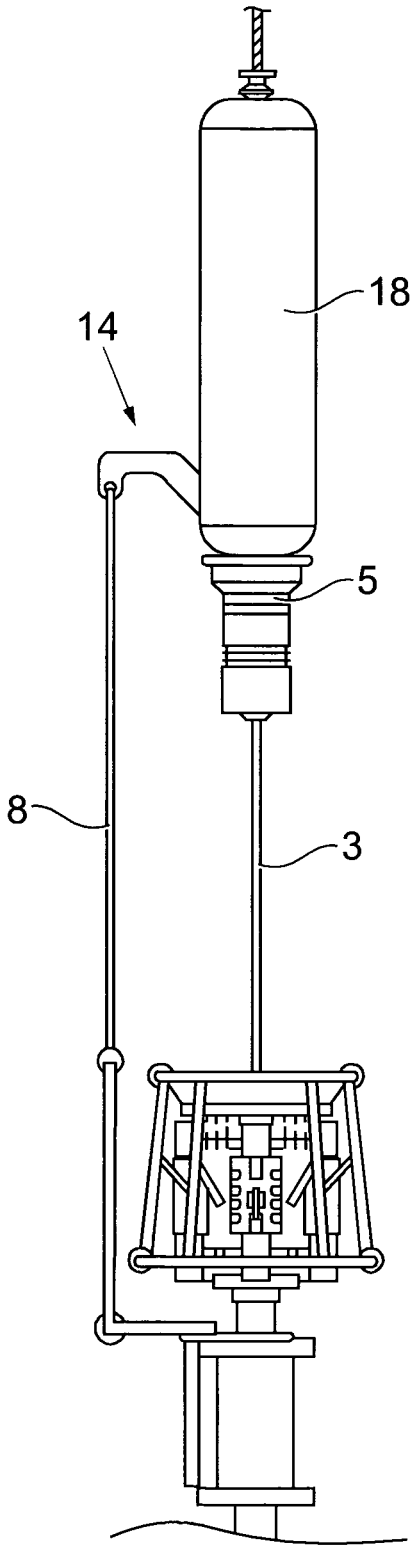
FIG. 3 is a schematic view of a subsea system according to a further aspect of the present invention.

A further embodiment of the present invention is shown in FIG. 3 in which a buoyancy device 18 is mounted above the test or lift mandrel 5 and the mandrel arm 14 is integral with or mounted to the buoyancy device.

In this embodiment, the addition of the buoyancy device 18 can assist in the recovery of the test or lift mandrel 5 or wireline mandrel 17 to surface by compensating for the weight of these items. In addition, the buoyancy device allows heavier tools to be run on any particular size of wireline by taking all, or a portion of, the weight of the tools and/or wireline mandrel. The reduction in hang off weight would in normal circumstances make deployment much more difficult as the lighter deployed load would be subject to much greater adverse influence by the prevailing currents. This invention negates this adverse affect as the guide line connecting the payload to the subsea well control package effectively pulls it in to the subsea well control package countering the effect of the current.

Figure 4:
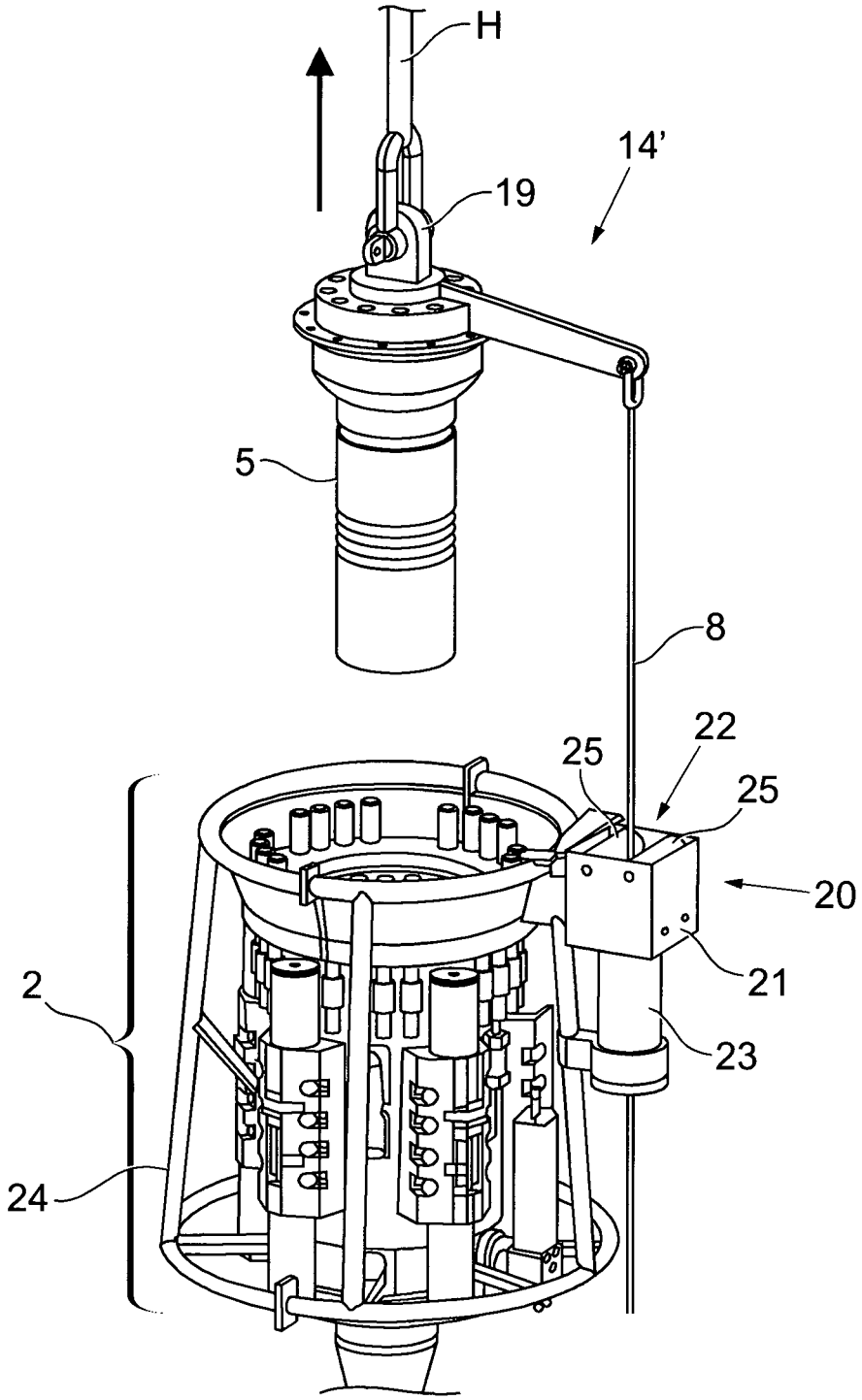
FIG. 4 is a schematic perspective view from above of the upper section of a subsea system according to a still further aspect of the present invention.

A further embodiment is shown in FIG. 4 in which the mandrel arm 14' is mounted to the upper surface of a test or lift mandrel 5 and extends substantially horizontally thereto. The test or lift mandrel has a lifting eye 19 mounted on the upper surface thereof to which a hoist line H is releasably attached from the surface.

In this embodiment a guide means 20 in the form of a guide block is mounted to the side of the subsea latch 2 to assist in guidance of the guide line 8 between the drum 9 and the mandrel arm 14'.

The guide block comprises a substantially square receptacle 21 which can be mounted on the side of the subsea latch through suitable fixing means. The receptacle has an open upper surface 22 and a tubular member extends 23 from the bottom of the receptacle to provide a path for the guide line.

The receptacle may be mounted to a protective frame 24 surrounding the subsea latch.

In the illustrated embodiment, two rollers 25 are mounted side by side in the upper region of the receptacle. The rollers may be rotatably mounted on spindles (not shown) which span the upper region of the receptacle.

A guide mechanism 26 may also be provided on the top surface of the subsea latch to assist in alignment of the test or lift mandrel into the subsea latch. As shown for example in FIG. 7, the guide means in one embodiment comprises a pair of opposed elongate metal or plastics strips 27.

In the illustrated embodiment the strips are curved and have an inner concave surface and an outer convex surface. The strips are mounted on the upper section of the subsea latch 2 adjacent to the receptacle 21 with the outer convex surfaces facing one another such that they provide a funnel action to introduce the mandrel arm 14' into the correct orientation for connection of the test or lift mandrel 5 to the subsea latch 2 or any other wireline equipment into the well.

A region of the upper framework 24 surrounding the subsea latch may be recessed or removed to allow the curved strips to be mounted on the control head.

Figure 5:
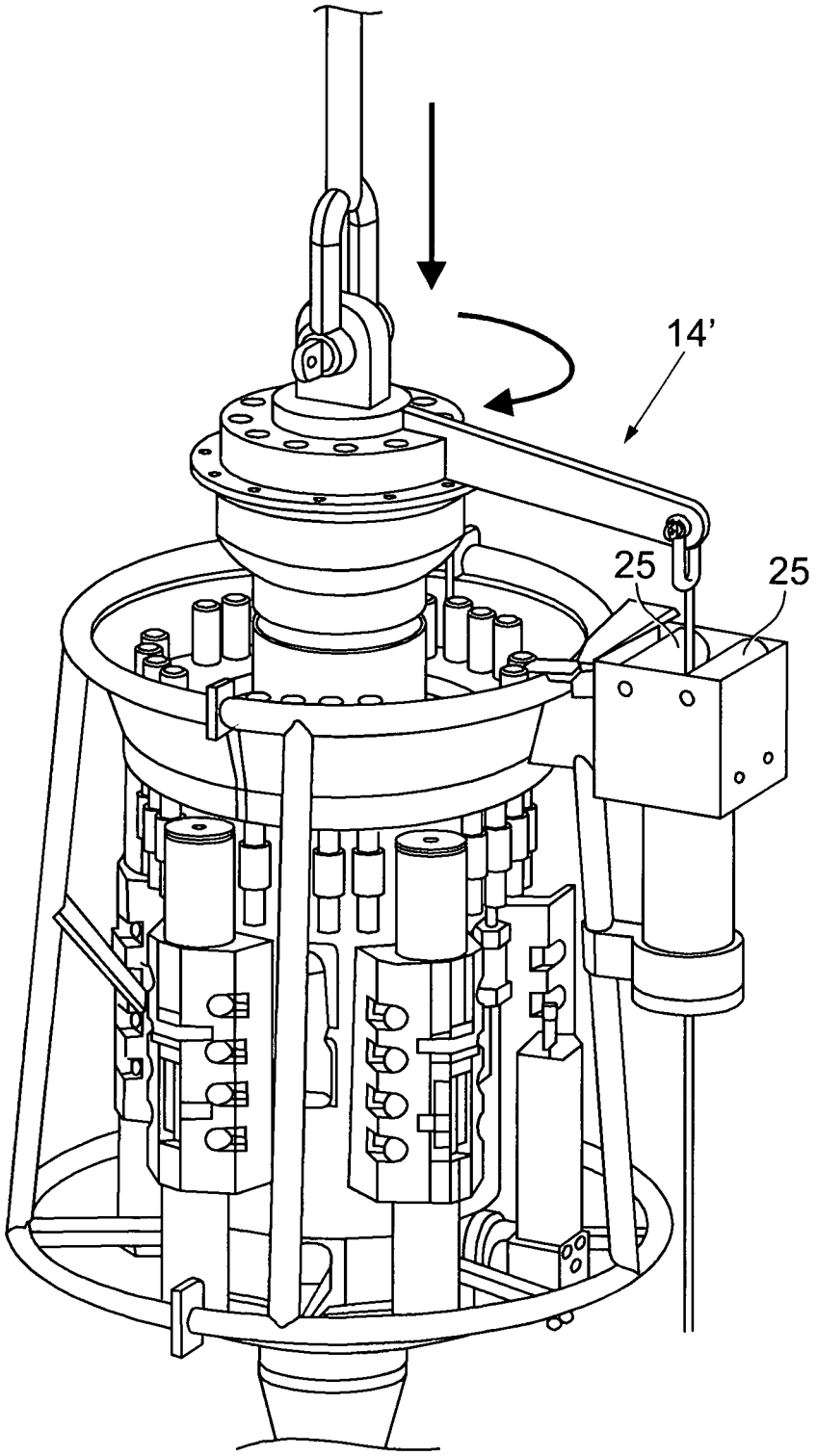
FIG. 5 is a schematic perspective view from above of the upper section of the subsea system of FIG. 4 as a test/lift mandrel approaches the subsea latch.
Figure 6:
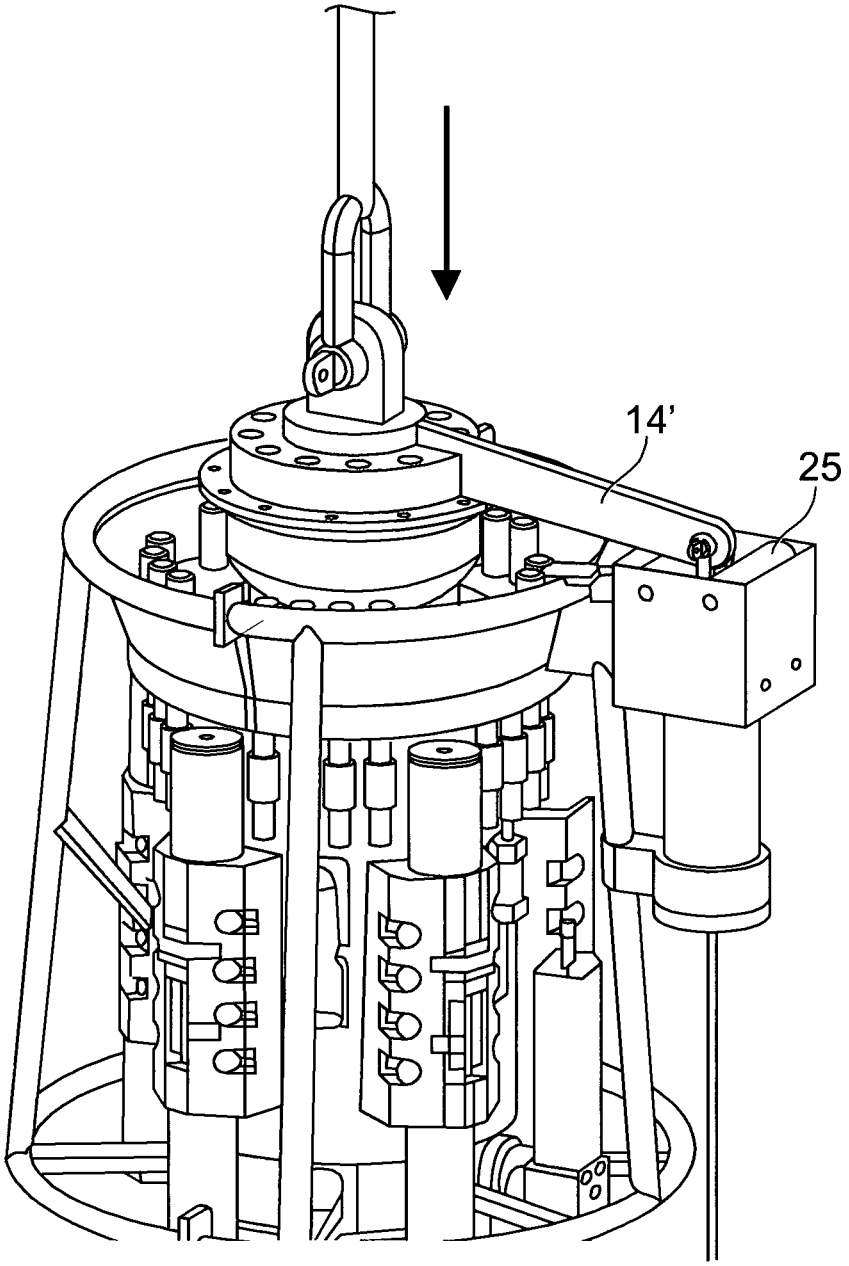
FIG. 6 is a schematic perspective view from above of the guidance mechanism of one embodiment of the present invention.

In use, as the mandrel arm 14' is pulled closer to the subsea latch 2 it will be forced to rotate about the vertical axis of the mandrel 5 as shown in FIG. 5, towards the receptacle 21 by the shortening of the guide line 8 between the drum 9 and the mandrel arm 14'. As the mandrel arm rotates it aligns above the opposed curved strips 27 of the guidance mechanism and further reeling in of the guide line 8 will draw the mandrel arm down between the two strips to provide fine alignment about the vertical axis see FIG. 6.

Figure 7:
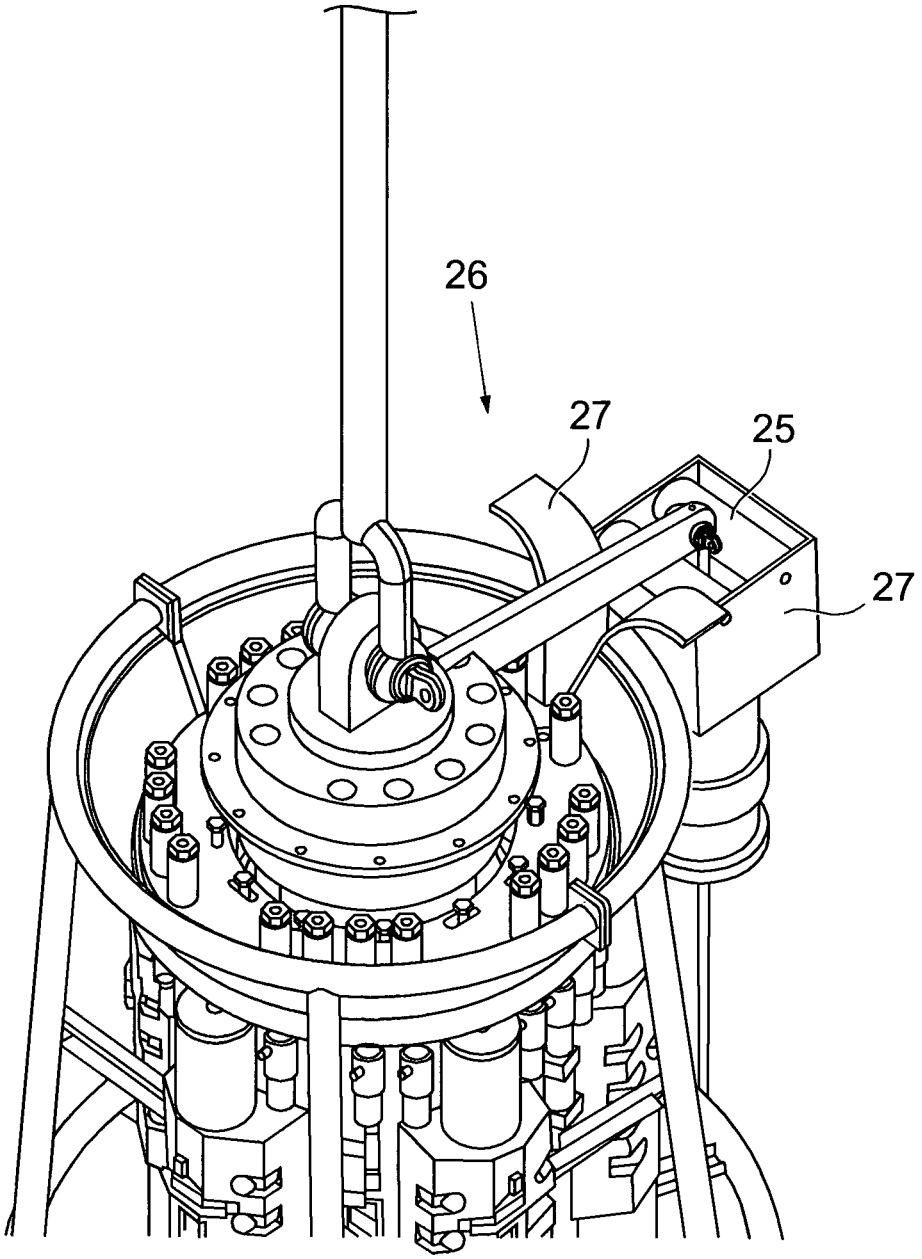
FIG. 7 is a schematic perspective view from above of the guidance mechanism of FIG. 6 in a partially aligned condition.
Figure 8:
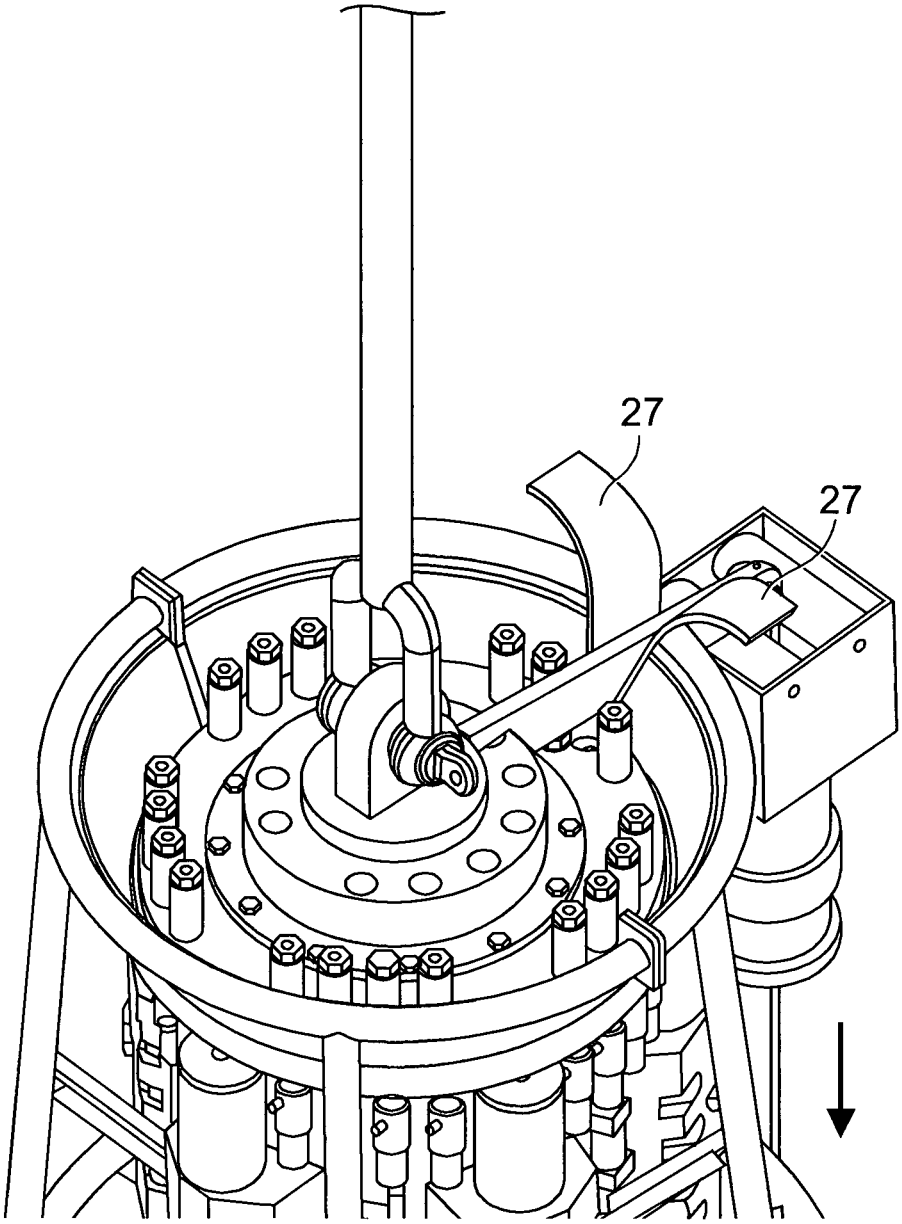
FIG. 8 is a schematic perspective view from above of the guidance mechanism of FIG. 7 in a fully aligned condition.

As shown in FIG. 7 the guidance rollers 25 (and hence the guide line 8 exiting from the rollers) are placed above the guidance receptacle parts 21 to ensure that the guideline 8 does not scuff or catch on the fixed guidance receptacle 21 when being paid out and wound in. This arrangement however places the fine alignment feature, which the mandrel arm 14' must enter, below the rollers 25 which the arm cannot pass through. The rollers are therefore mounted in such a manner that they are free to move downward when contacted by the mandrel arm 14' as it is drawn down so exposing the fine alignment feature 26 for the arm to engage with as it completes its downward movement as shown in FIG. 8.

FIG. 9 shows a further embodiment of the invention where the subsurface motor 11 and drum 9 are located at the base of a lubricator section 28 within a protective frame work 29. This can afford the motor and drum protection and, depending on the access provided for personnel on the vessel, places it at a more convenient location for inspection and/or maintenance.

Embodiments of the present invention provide a subsea intervention system and a method of guiding equipment towards a subsea installation without the risk of tangling or twisting of guidance wires. Furthermore, the risk of abrasion of the outer surface of the equipment or to components such as umbilicals connected to the outer surface of the equipment by the guidance wires is also removed.

Furthermore, embodiments as described do not suffer from the problems of free hanging equipment drifting out of alignment due to currents as it passes through the water column and the equipment can be safely and securely deployed from the surface and guided to the subsea installation without the need for diver or ROV supervision of the guidance system which is both more cost effective and more safety oriented that currently available devices and methods.

A further embodiment of the present invention is shown in FIGS. 10-19 where the guide line 38 is provided by an upper and lower guide line operating in unison to provide well intervention.

In the embodiment as shown, a well control package P is suspended from a surface vessel V into the column of water and a piece of subsea equipment, in this case a lubricator assembly 30, is mounted on top of the well control package.

In this embodiment the lower guide line 31 is controlled by an electric/hydraulic winch similar to the winch described above, positioned on the lubricator assembly. The lower guide line comprises a light weight tension/electric/communications cable wound onto the reel 9 of the winch. The lower end of the cable feeds power and communications as required to the intervention system.

The upper end of the guide line 31 is attached to an interface 32 at the lubricator assembly 30. This interface supports the guide line 31 while providing connection to a mating connector from above. When the mating connector is raised or lowered within the water column, the winch pays out and maintains power, communications and guidance across any equipment suspended at the upper/lower line interface with the intervention system.

The upper line 33 comprises a combined tension/electric/communications cable which has the tensile capacity to support a subsea fluid power unit 34 (or any other package of equipment) through the water column. The upper guide line 33 is fed from a reel (not shown) mounted on the vessel V. This vessel mounted reel can be set as a control reel or alternatively be set to a constant tension. The lower end of the upper line may terminate in a connector that interfaces with a mating connector on the supported equipment package. Electric power or communication is fed to the supported package and/or through the package into the lower line 31 of the guide line as required.

The combination of the lower & upper lines of the guide line 38 maintains a continuous single line from the equipment on the seabed through the deployed equipment package to the vessel.

Figure 18:
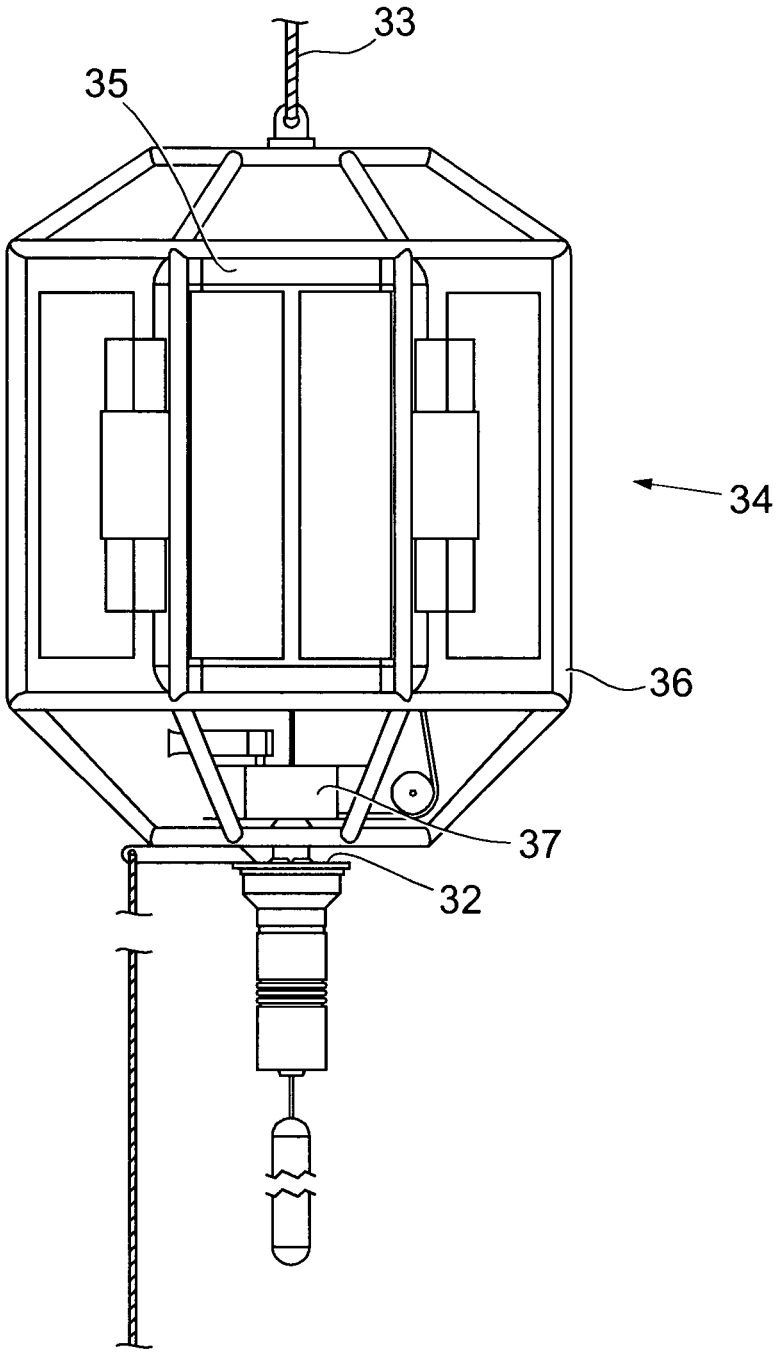
FIG. 18 is a schematic view of a subsea fluid power unit of the further embodiment.
Figure 19:
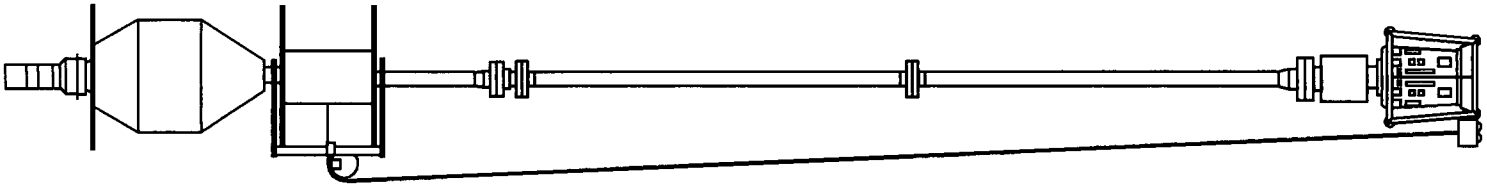
FIG. 19 is a more detailed view of the lubricator section of FIG. 10, and FIGS. 20 *a-f* are schematic views of a deployment sequence of a further embodiment of the present invention.

A subsea fluid power unit 34 as shown in FIG. 18, is a compact unit combining a conventional lubricator mandrel, stuffing box and deployed toolstring with the electrical controls, communications and fluids required to control the intervention system and carry out wireline operations.

The subsea fluid power unit comprises multiple electro hydraulic power units, primarily grease injection, subsea control fluid for the well control system, subsea control fluid for the client xmas tree and down hole safety valve, chemicals and subsea lubricator flushing fluid. Additionally, multiple storage tanks, primarily for grease, subsea intervention control fluid, subsea control fluid for client equipment, chemicals and flushing fluid are also provided. Buoyancy units or tanks 35 may be provided on the subsea fluid power unit to provide support for the weight of the unit and to assist in handling. A protective frame 36 may be provided around the unit.

The subsea fluid power unit also comprises a subsea wireline unit 37, subsea connector mandrel, a tool mounting receiver or catcher and subsea controls/pressure compensation units for all of the above.

Existing systems can be adapted to incorporate the key components of the invention. The system can also be used solely for guidance of equipment to the well control package thereby replacing guidewires for guiding equipment subsea in accordance with the method described above in relation to other embodiments.

FIGS. 10-17 illustrate the deployment sequence.

Figure 10:
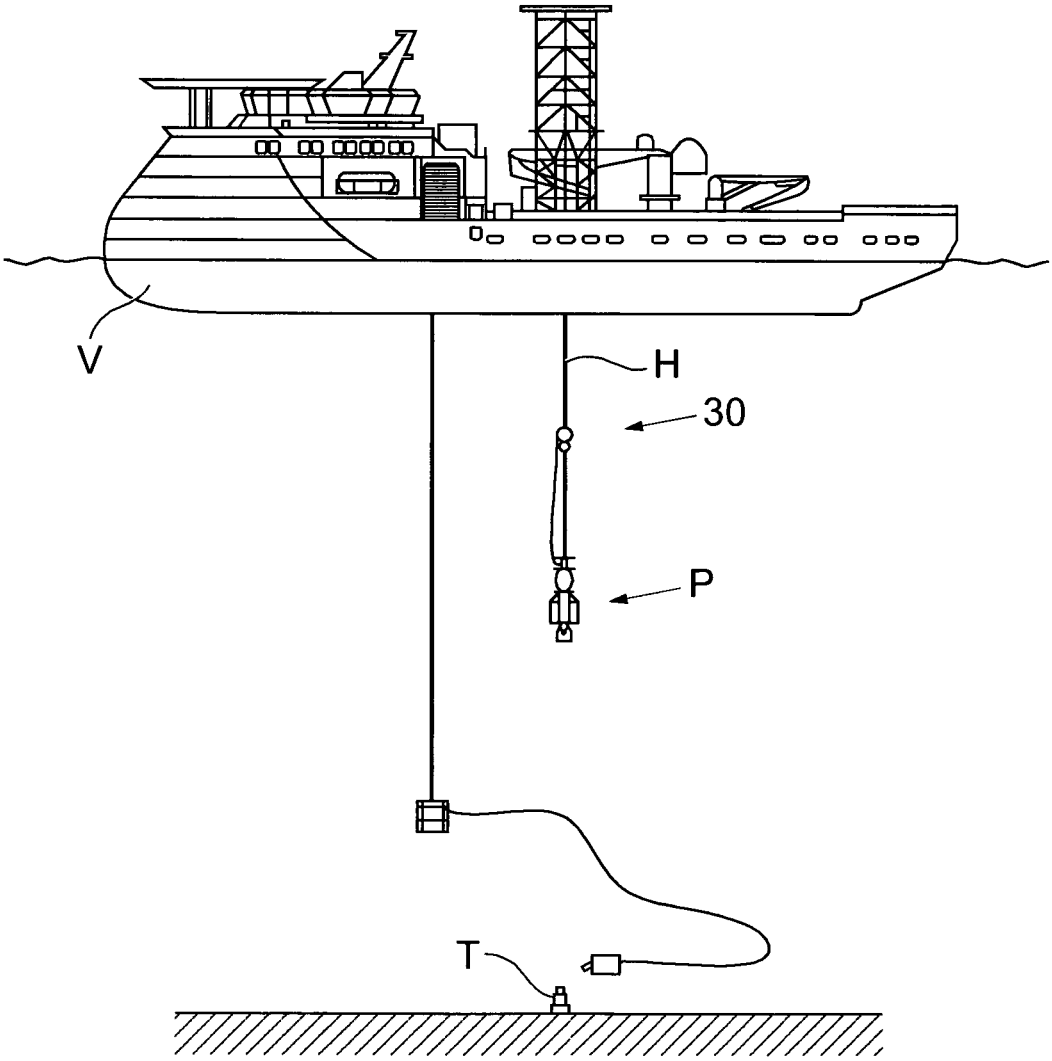
FIGS. 10-17 are schematic views of the deployment of a system according to a further embodiment of the present invention.
Figure 11:
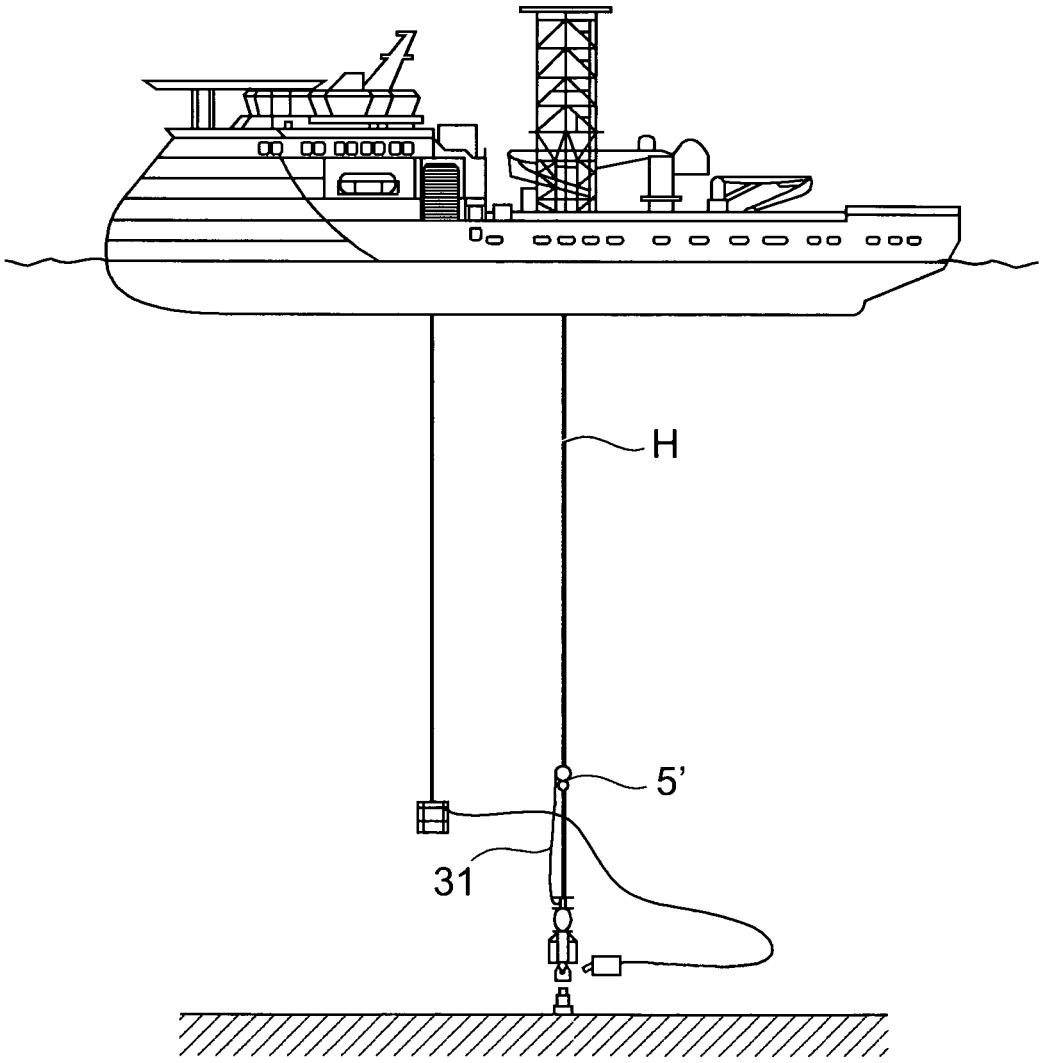
Figure 12:
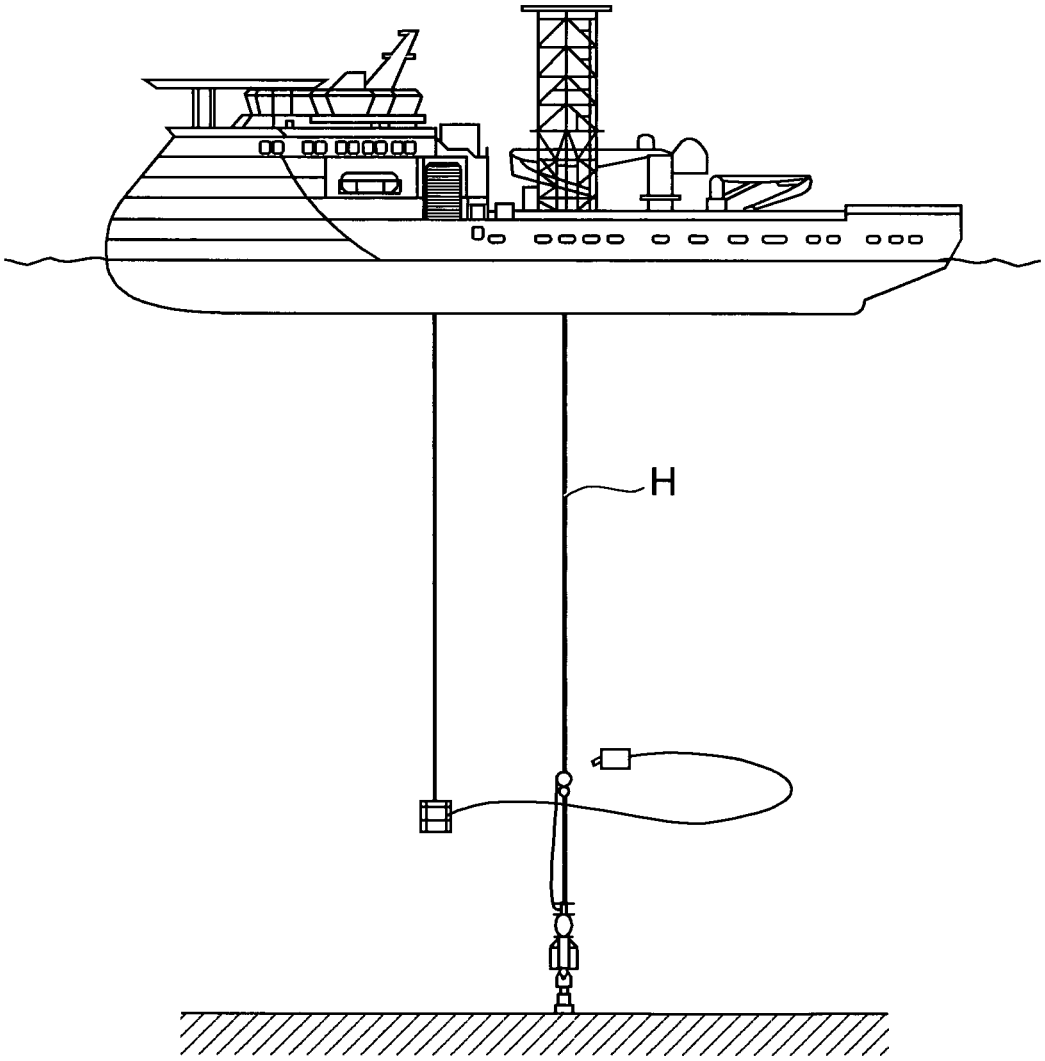
Figure 13:
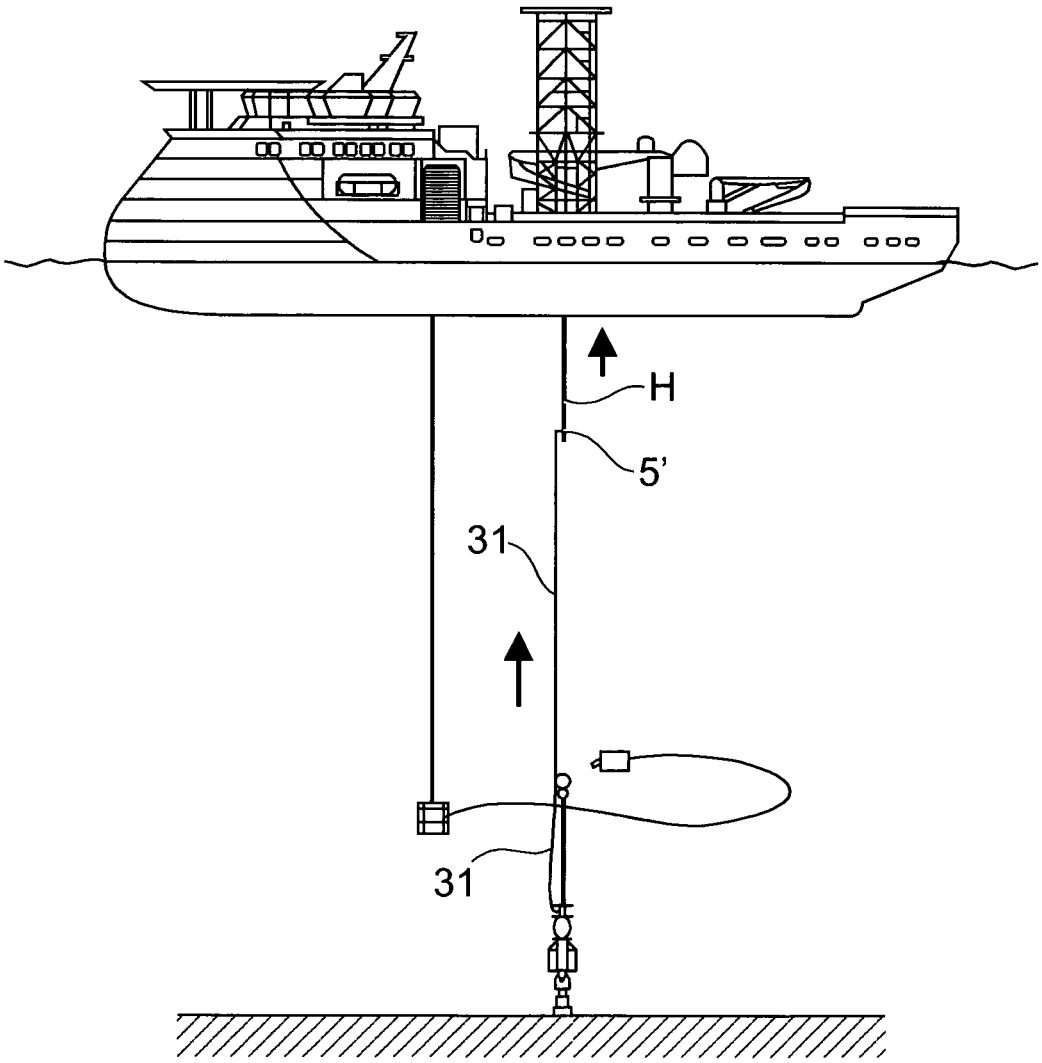

Once the well control package P has been deployed on the main hoist wire/rope it may be guided into position above the xmas tree T by an ROV. In FIG. 10, an ROV is shown which is powered from an ROV management package suspended in the water beneath the vessel on a dedicated umbilical. The well control package is locked onto the subsea xmas tree as shown in FIG. 11 and the lift/test mandrel 5' to which the upper end of the lower line 31 of the guide line is attached, is disconnected and pulled up to surface by the main hoist wire/rope H as shown in FIGS. 12 and 13.

Figure 14:
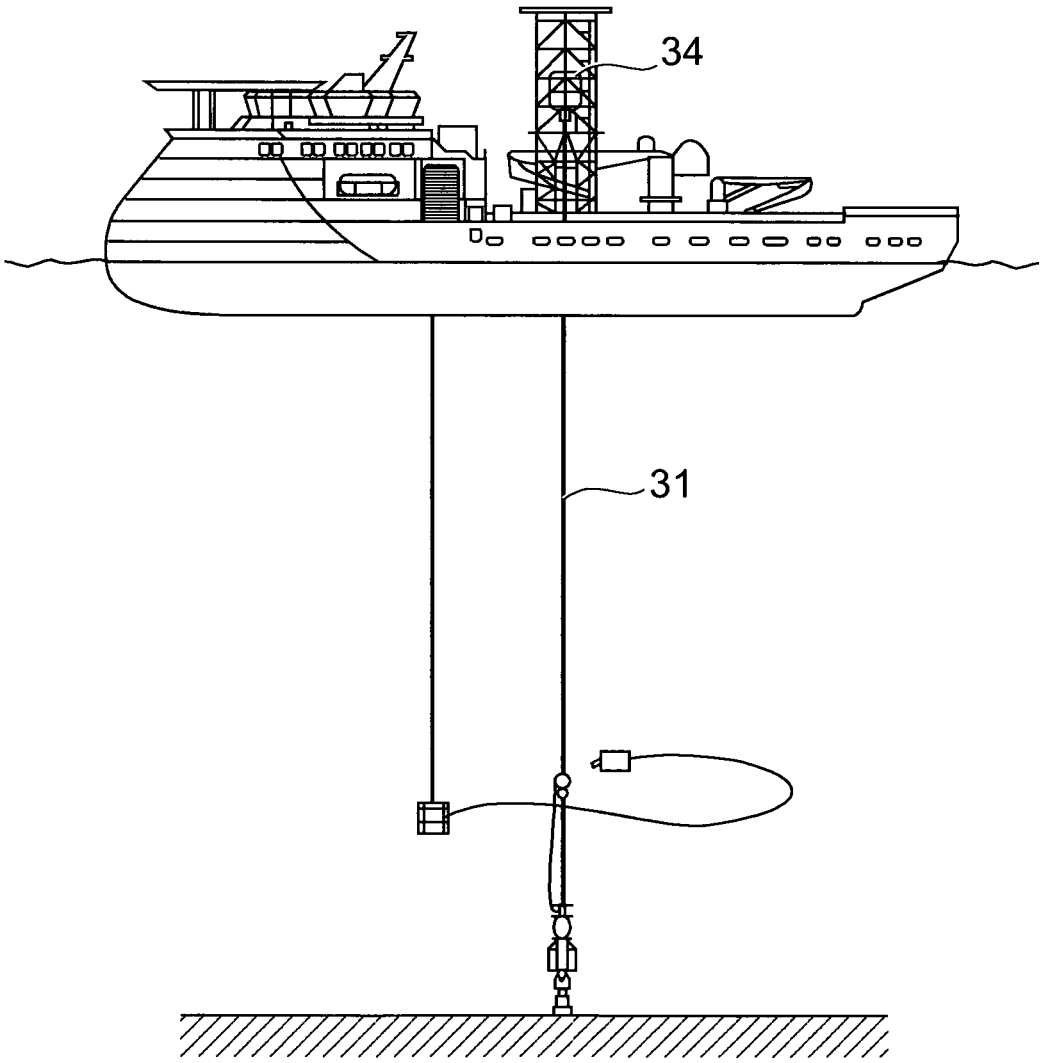
Figure 15:
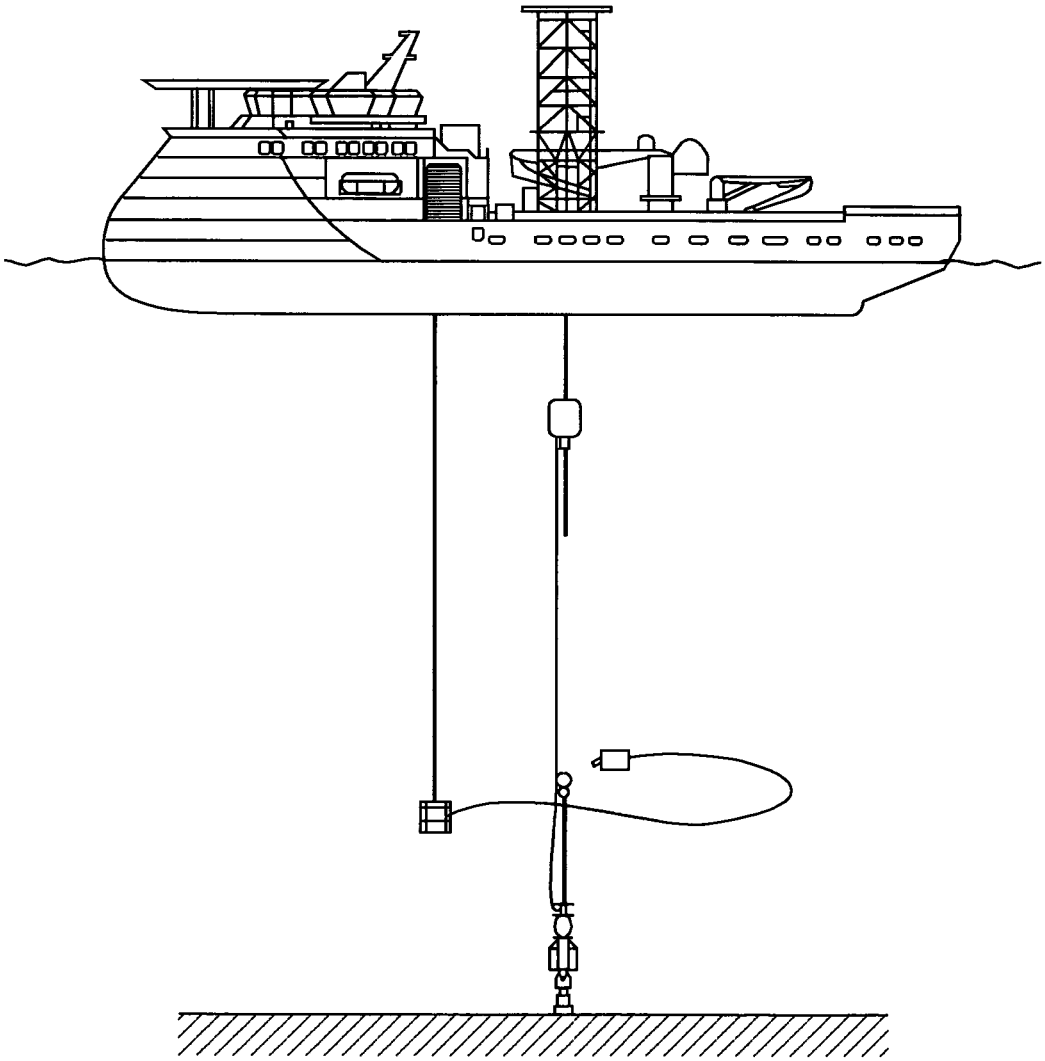

The upper guide line 33 is then connected to the subsea fluid power unit 34 on board the vessel and the power unit is then deployed from the vessel on the upper guide line 33 which acts as the main load bearing umbilical with the required tool typically held within the tool catcher. As the upper guide line 33 is paid out the light weight guide line 31 is reeled in guiding the subsea fluid power unit to the intervention system. This is shown in FIGS. 14 and 15.

The winch positioned on the intervention system can also be used for monitoring the movement of the vessel V relative to the intervention system (stationary) and therefore it can be used for active heave compensation purposes.

Figure 16:
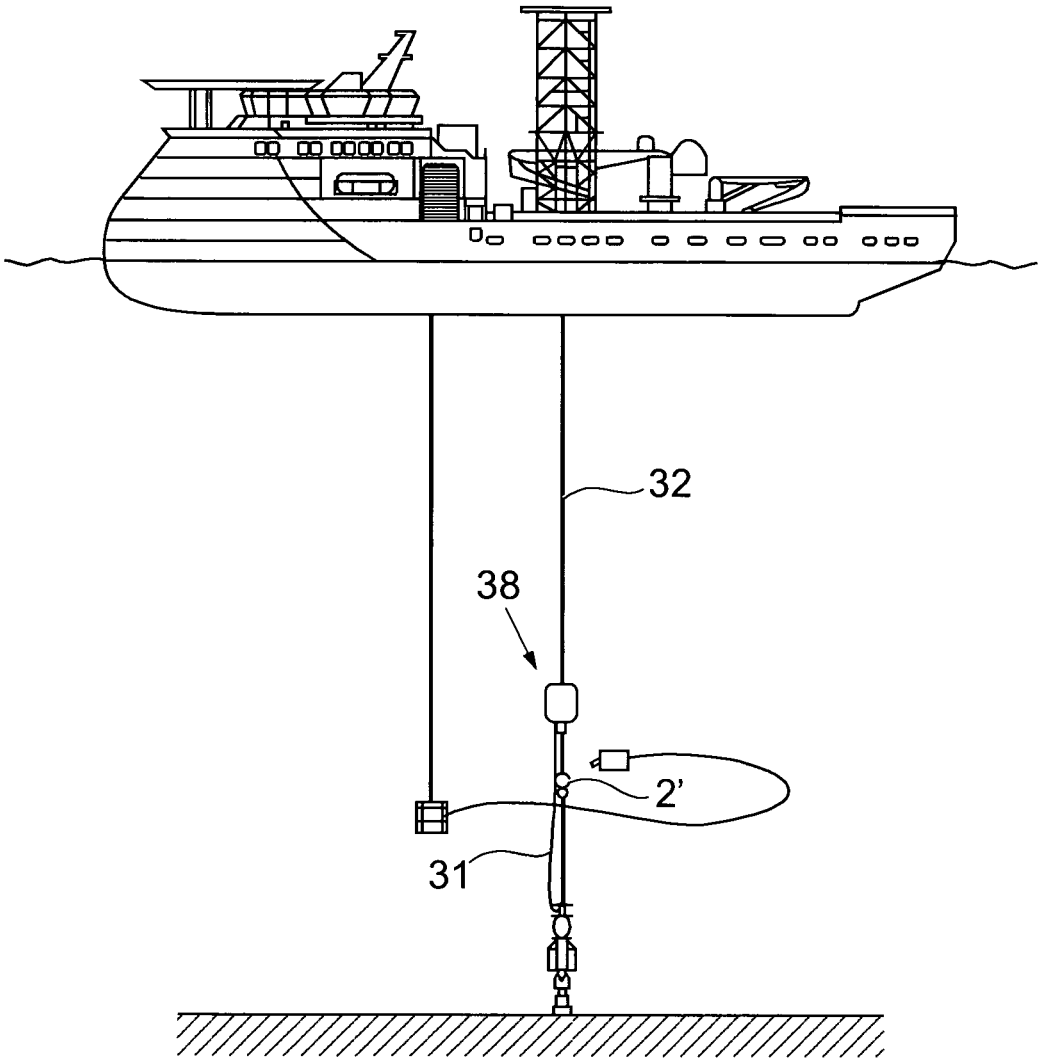

Once the mandrel on the subsea fluid power unit 34 is engaged into the subsea latch 2' at the top of the lubricator as shown in FIG. 16, further fluid, power and communications connections are made. Connection of the subsea fluid power unit 34 to the lubricator 30 may be assisted by the ROV as shown.

The hydraulic power units on the subsea fluid power unit can be activated to top up fluid reserves and function valves etc on the well control package P. The deployment, control and monitoring of the wireline toolstring into the well is then performed by means of the upper guide line 33 acting as load bearing umbilical upon which the subsea fluid power unit is supported.

Figure 17:
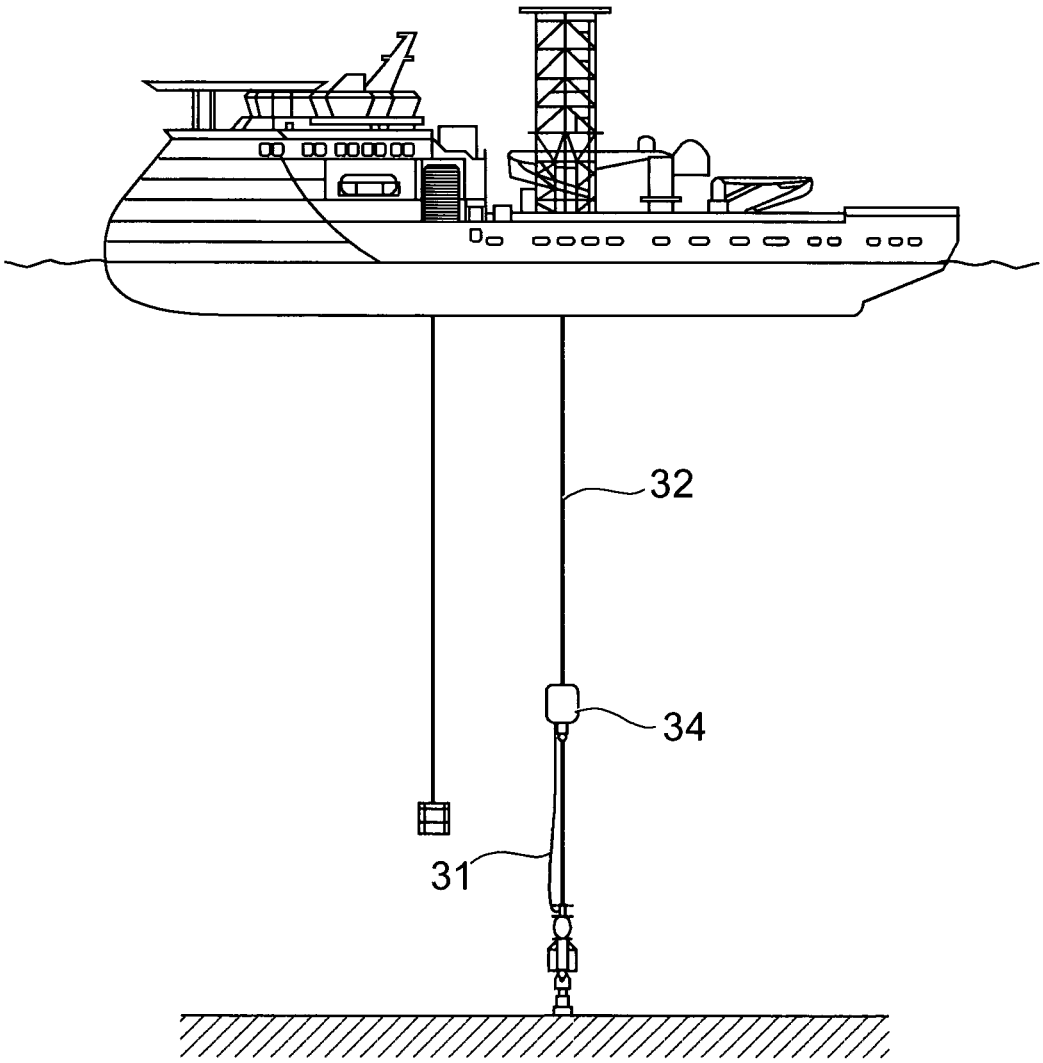

FIG. 17 shows the subsea fluid power unit 34 in operational position on the well control package.

Once the operation of the deployed string is completed, the lubricator 30 can be flushed out using the fluid stored within the tanks onboard the subsea fluid power unit then the mandrel can be released allowing the upper guide line 33 to be reeled in to lift it to surface and in turn to raise the light weight combined umbilical/guide line 31.

At surface the subsea fluid power unit 34 can be topped up with any required fluids prior to being redeployed to carry out further operations.

The above steps are then repeated until the required job is complete, at which time the lift mandrel 5' is deployed to recover the intervention system from the seabed.

Figure 20:
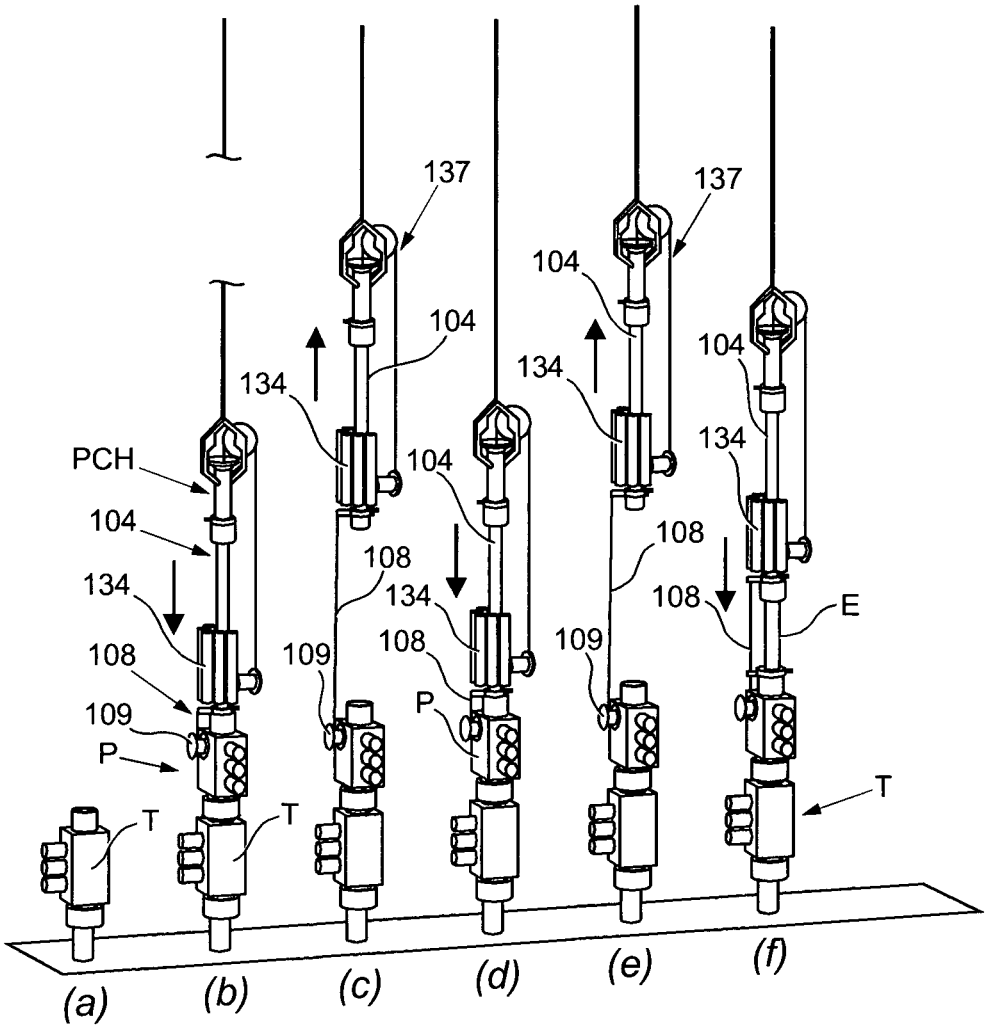

FIGS. 20 *a-f* show the deployment sequence of a further embodiment of the present invention. Like reference numerals have been used to identify similar elements as disclosed in relation to earlier embodiments with an increase of 100.

In this embodiment, the guidance winch and the guide line 108 is stored on a horizontally oriented drum or reel 109 which is mounted on the well control package P. The driving means for the drum may also be mounted on the well control package. The free end of the guide line 108 is attached to an arm 114 at the base of the subsea fluid power unit 134. The power unit and arm are both attached to the base of a lubricator section 104.

The subsea wireline unit 137 is also mounted on the lubricator section 104 with the winch of the subsea wireline unit mounted on the base of the subsea fluid power unit (134). The pressure control head is mounted on an upper part of the lubricator section.

In this configuration the size and weight of both the subsea fluid power unit and the wireline winch are supported at a lower position then the earlier embodiments which reduces the mass and area exposed to the prevailing currents and therefore imparts far less loading to the lubricator section during operations.

With the wireline winch mounted on the lubricator section, the lubricator section together with the pressure control head are both retrieved to the surface for tool change out. The guide line 108 serves the same purpose as with earlier embodiments in guiding the movement of the lubricator section towards and away from the well control package.

Referring to FIGS. 20 *a-f*, the deployment sequence will now be described.

Initially the well control package P, subsea lubricator 104 and power control head are run subsea and latched onto the Xmas Tree T. The deployment line H bears the weight of the full assembly during deployment and also provides electrical power and control. Control and power connectivity are maintained from the deployment line via a standard subsea rated connection at the power control head to subsea lubricator interface and via the combined load/power/control guidance line between the subsea lubricator and the well control package.

The wireline tool string is pre mounted in the lubricator section 104 with the wireline passing out of the pressure control head and running over a sheave at the top of the lubricator section from where it runs down outside the lubricator section to the wireline winch mounted at the base.

Upon completion of lock on and integrity checks, the well barriers are opened and the wireline tool deployed into the well to carry out the intended operations. Power and control of the wireline operation is maintained from the surface via the deployment line.

Upon completion of downhole work, the wireline tool string is retrieved back into the subsea lubricator section and the well barriers are closed.

In step c the subsea lubricator and the power control head assembly are unlocked from the well control package and the assembly is retrieved to the surface. The guidance line 108 pays out as the assembly is raised through the water column so maintaining physical contact and control with the subsea assembly.

On the surface the pressure control head is unlatched from the subsea lubricator section and the tool string is changed out as required. The pressure control head is then re-latched to the subsea lubricator and pre-deployment checks are carried out.

In step d the subsea lubricator and pressure control head assembly is then rerun subsea once more. During deployment the guidance line 108 performs its primary function of guiding the subsea lubricator section and pressure control head assembly towards the well control package at which point the subsea lubricator is landed on and locked onto the well control package. As before, following checks, the well barriers are opened and wireline operations carried out as required.

In step e the pressure control head and subsea lubricator are retrieved to the surface for tool string change out.

In the event of the tool string becoming lost downhole, it is required to retrieve the lost tool string by fishing with a specialised fishing tool string. In order to accommodate the fishing tool string together with the original tool string above the well barriers in the well control package, it is required to add an extension to the lubricator. Step f illustrates the subsea lubricator and pressure control head having been deployed with an extension E installed to carry out fishing operations. In this configuration the end of the guidance line has been transferred from the base of the subsea lubricator to the base of the fishing extension.

On completion the well barriers are closed and the subsea lubricator and pressure control head are retrieved to the surface.

The well intervention system described overcomes each of the basic problems of deep water well intervention in a system that is equally applicable to shallow water intervention. The overall system bulk and footprint on the vessel is minimised, a load is guided securely through a column of water of whatever depth is required whilst the cables and wires are controlled to prevent damage during deployment. Additionally the supply of fluid to the intervention system is simplified and localised and the overall cost of the system is reduced.

Modifications and improvements are also envisaged to the invention. For example, the guide line 8, 38 may be replaced with a rope or other element which can operate subsea.

Embodiments of the invention have been described with particular emphasis on the use of well logging equipment which is lowered into and recovered from a well, however it is envisaged that the invention could be used with any equipment which is suspended from a surface vessel or platform and lowered into and recovered from a well, or any equipment which is lowered to and mounted on a subsea wellhead.

It will be appreciated that the subsea system described above can also be used in any application where a load has to be deployed to and recovered from a subsea package of any description.

The invention claimed is:

1. An intervention or deployment subsea system comprising:

a subsea spool;

a carrier suspended from a surface vessel or platform;

a guide line wound on the spool, a free end of the guide line connected to the carrier; and a bi-directional motor for driving the subsea spool in a first direction to pay out a length of the guide line as a distance between the subsea spool and the carrier within a water column between the surface vessel or platform and the subsea spool is increased and in a second direction to reel in the length of the guide line as the distance between the subsea spool and the carrier decreases, the guide line to the subsea spool restraining movement of the carrier to within the water column between the surface and the subsea spool.

2. The subsea system according to claim 1, wherein the carrier comprises a subsea fluid power unit.

3. The subsea system according to claim 1, wherein the carrier comprises a test/lift mandrel.

4. The subsea system according to claim 1, wherein the carrier comprises a lubricator section.

5. The subsea system according to claim 1, wherein the guide line comprises upper and lower guide lines.

6. The subsea system according to claim 5, wherein the lower guide line maintains power, communications and/or guidance across any equipment suspended from the carrier.

7. The subsea system according to claim 1, further comprising guidance members for guiding the guide line between the spool and the carrier.

8. The subsea system according to claim 7, wherein the guidance members comprise a guide arm.

9. The subsea system according to claim 8, wherein the guide arm is mounted on or adjacent to the spool.

10. The subsea system according to claim 8, wherein the guidance members comprises an L-shaped guide arm.

11. The subsea system according to claim 8, wherein the guidance members further comprises one or more rollers or sheaves mounted for rotation on the guide arm.

12. The subsea system according to claim 8, wherein the guidance members further comprises a receptacle mounted on a subsea component through which receptacle the guide line passes.

13. The subsea system according to claim 12, wherein the receptacle is provided with opposed rollers to guide and/or grip the guide line.

14. The subsea system according to claim 7, wherein the guidance members further comprises channelling means mountable on a subsea component for orienting the carrier as the carrier approaches the spool.

15. The subsea system according to claim 14, wherein the channelling means comprises a pair of opposed elongate curved members.

16. The subsea system according to claim 1, wherein the carrier comprises a mandrel adapted to be suspended from the surface vessel or platform.

17. The subsea system according to claim 16, wherein the carrier further comprises an arm extending from the mandrel.

18. The subsea system according to claim 1, wherein the spool is vertically oriented.

19. A method of guiding a component through a water column between a surface and a subsea installation comprising the steps of:

mounting the component on or to a carrier;

attaching a first end of a guide line to a subsea spool;

attaching a second end of the guide line to at least one of the component and the carrier; and driving the subsea spool, via a bi-directional motor, to manoeuvre the component to a required position, wherein the driving comprises at least one of driving the subsea spool in a first direction to pay out a length of the guide line as a distance between the subsea spool and the carrier within the water column between a surface vessel or platform and the subsea spool is increased and driving the subsea spool in a second direction to reel in the length of the guide line as the distance between the spool and the carrier decreases, the guide line restraining movement of the carrier to within the water column between the surface and the subsea spool.

20. The method according to claim 19, wherein the method further includes the step of aligning the component with a further subsea component.

21. The method according to claim 20, wherein the step of aligning comprises rotating the component about a vertical axis prior to docking with the subsea component.

22. The method according to claim 19, wherein at least one of power and communication is established across the component during guidance thereof.

* * * * *